US009326611B1

(12) United States Patent
Briggs et al.

(10) Patent No.: US 9,326,611 B1
(45) Date of Patent: May 3, 2016

(54) PORTABLE BLEACHER WITH ACTIVE DESCENT AND LIFT MECHANISM

(71) Applicant: Hussey Seating Company, North Berwick, ME (US)

(72) Inventors: Kerry D. Briggs, North Berwick, ME (US); Chi-Lam Yau, Dover, NH (US); Robert G. Valliere, Jr., Lyman, ME (US)

(73) Assignee: Hussey Seating Company, North Berwick, ME (US)

( * ) Notice: Subject to any disclaimer, the term of this patent is extended or adjusted under 35 U.S.C. 154(b) by 0 days.

(21) Appl. No.: 14/627,647

(22) Filed: Feb. 20, 2015

Related U.S. Application Data

(60) Provisional application No. 61/943,027, filed on Feb. 21, 2014.

(51) Int. Cl.
*E04H 3/12* (2006.01)
*A47C 1/12* (2006.01)
*E04H 3/14* (2006.01)

(52) U.S. Cl.
CPC ..... *A47C 1/12* (2013.01); *E04H 2003/145* (2013.01)

(58) Field of Classification Search
CPC ..... A47C 1/12; E04H 2003/145; E04H 3/12; E04H 3/123
USPC ..... 52/8–10; 297/14, 217.7
See application file for complete search history.

(56) References Cited

U.S. PATENT DOCUMENTS 2,018,887 A * 10/1935 Fowler ..... E04H 3/126 52/10
2,817,122 A * 12/1957 Walworth ..... A47C 1/126 297/243
3,230,907 A * 1/1966 Morford ..... E04H 3/126 108/92
3,464,753 A * 9/1969 Van Ryn ..... A47C 1/12 297/232
3,747,708 A * 7/1973 Wenger et al. ..... E04H 3/126 182/152
3,869,835 A * 3/1975 Mackintosh ..... E04H 3/123 52/183
5,381,873 A 1/1995 Kniefel et al.
5,547,205 A * 8/1996 do Rosario Sousa de Cabedo ..... B62B 5/085 280/30
5,979,125 A * 11/1999 Guillet ..... E04H 3/126 296/26.02
6,003,270 A * 12/1999 MacIntyre ..... E04H 3/126 52/10
6,527,341 B1 * 3/2003 Martin ..... A47C 7/58 248/240.4
6,625,932 B1 * 9/2003 Littlefield ..... E04H 3/126 52/10
7,814,708 B2 * 10/2010 Rivera, Jr. et al. ..... E04H 3/126 182/132
8,296,999 B2 * 10/2012 Uhl ..... E04H 3/126 52/66
8,413,384 B2 4/2013 Rivera, Jr. et al.

OTHER PUBLICATIONS

Ango Portable Bleacher, Manufacturer: Avant Bleacher, Shenzhen, China, URL:http/ /www.avantbleacher.com/product/showproduct.php?lang=en&id=30.

* cited by examiner

*Primary Examiner* — Brian Glessner
*Assistant Examiner* — Paola Agudelo
(74) *Attorney, Agent, or Firm* — Preti Flaherty Beliveau & Pachios LLP

(57) ABSTRACT

A portable bleacher seating structure includes an active descent and lift mechanism that includes a placement assembly having an arm and an arm wheel at a distal end thereof. A bracket connects the arm to a gas spring. The pressure within the gas spring opposes the arm as the bleacher is positioned in order to control the descent of the bleacher as it is tipped into position.

19 Claims, 14 Drawing Sheets

PORTABLE BLEACHER WITH ACTIVE DESCENT AND LIFT MECHANISM

BACKGROUND OF THE INVENTION

The factors when considering a seating arrangement within a venue, whether it is a gymnasium, lecture hall, auditorium or concert hall are numerous and well known. When it comes to gym bleachers and gymnasium seating for schools and community centers, however, maximum flexibility, reliability and utility are three of the most important factors. As is known, one solution includes telescopic seating that is stowed away but always ready for the next event or activity. Retractable, telescopic gym bleachers can be configured in an endless variety of ways to accommodate seating for school sports, ADA seating access requirements and general seating for public events. The telescopic bleachers attach to an indoor wall in multi-tier banks of seating that can provide custom bleacher seat arrangements for an event.

While telescopic bleachers offer tremendous flexibility the structure is still fixed in place. is What is needed, therefore, is a seating solution that provides a different level of flexibility than that offered by telescopic bleachers.

BRIEF SUMMARY OF THE INVENTION

In one embodiment of the present invention, a portable bleacher seating structure provides the safety, comfort and durability of large gym bleacher systems to nearly any spot. The portable bleacher is designed for quick and easy one-person transport and one-person operation. The bleacher is sized to fit through tight doorways and onto elevators. The closed deck portable bleacher includes ergonomically contoured polymer seats and a lightweight aluminum frame.

In one embodiment, an active descent and lift mechanism allows the portable bleacher unit to be placed by one person. By extending the fraction arms, tipping the bleacher unit, and locking the unit down, the bleacher is ready for guests. In one embodiment, gas struts provide controlled descent and lift assistance.

BRIEF DESCRIPTION OF THE SEVERAL VIEWS OF THE DRAWINGS

Various aspects of at least one embodiment of the present invention are discussed below with reference to the accompanying figures. It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. For purposes of clarity, not every component may be labeled in every drawing. The figures are provided for the purposes of illustration and explanation and are not intended as a definition of the limits of the invention. In the figures.

DETAILED DESCRIPTION OF THE INVENTION

This non-provisional application claims priority from U.S. Provisional Application 61/943,027, filed Feb. 21, 2014, entitled "Portable Bleacher with Active Descent and Lift Mechanism," the entire contents of which is incorporated by reference herein for all purposes.

Figure 1:
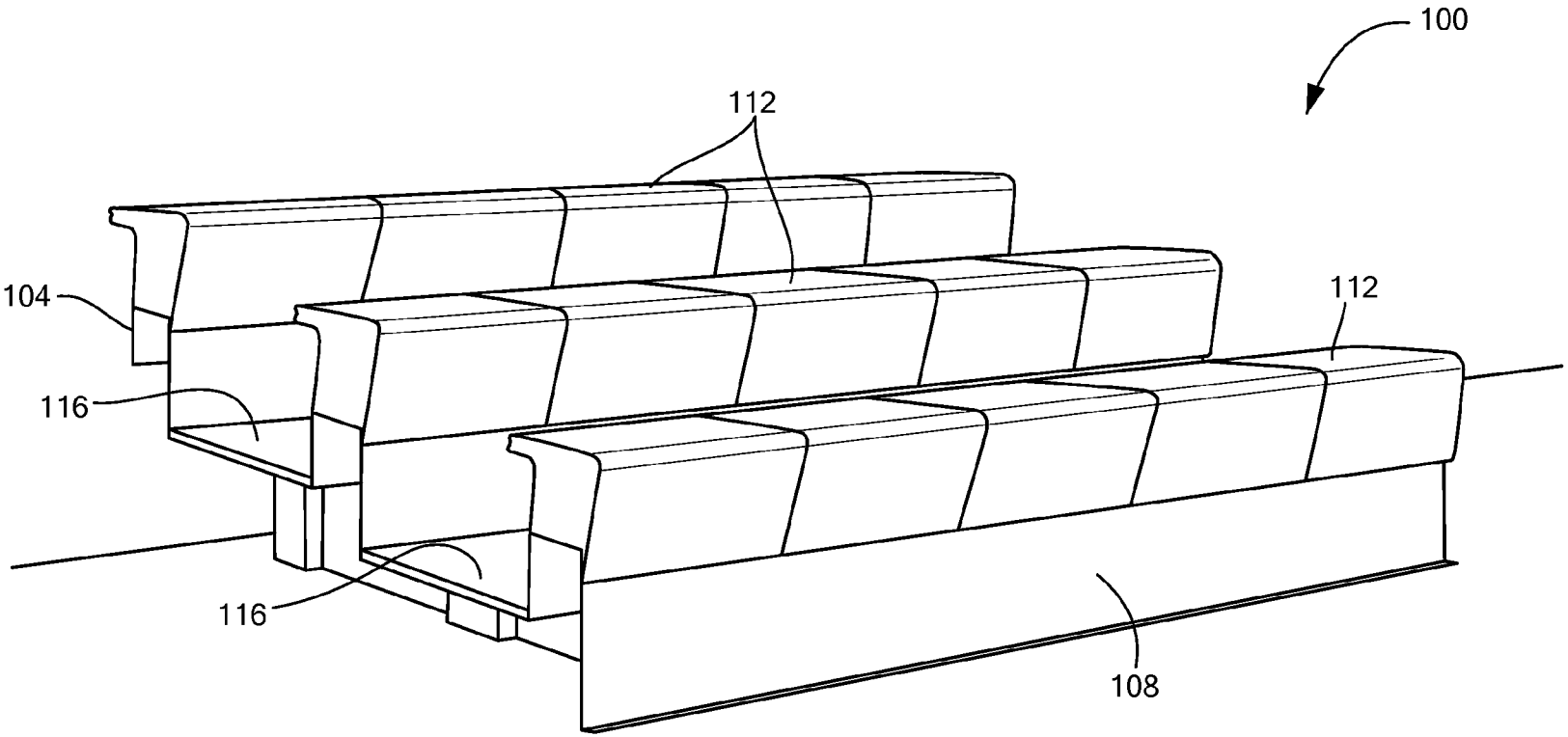
FIG. 1 is a front and side perspective view of a portable bleacher in accordance with one embodiment of the present invention.

Referring now to FIG. 1, a portable bleacher 100 includes a tiered frame 104 including a front portion 108. A number of seat portions 112, for example three, as shown, are provided on the frame 104. The number of tiers may be chosen so that the total height of the bleacher 100 is less than the width of the smallest door of a facility such that the bleacher may pass through. Between each of the seat portions 112 or tiers of the frame 104, a closed deck portion 116, for example, made from aluminum or plywood, is provided in order to prevent someone from falling through or otherwise becoming entangled in the portable bleacher 100. Generally, a user sits in a corresponding seat portion 112 and faces toward the front portion 108 in order to observe the event, performance, etc.

The seat portion 112 may either be configured as a continuous bench or could include individual and ergonomically contoured seats made from a polymer or other similar material to provide a comfortable support for an individual. Further, the number of contoured seats on a riser may be changed to accommodate, for example, a cup holder and/or flat surface to allow for food, drinks, etc. to be placed.

Figure 2:
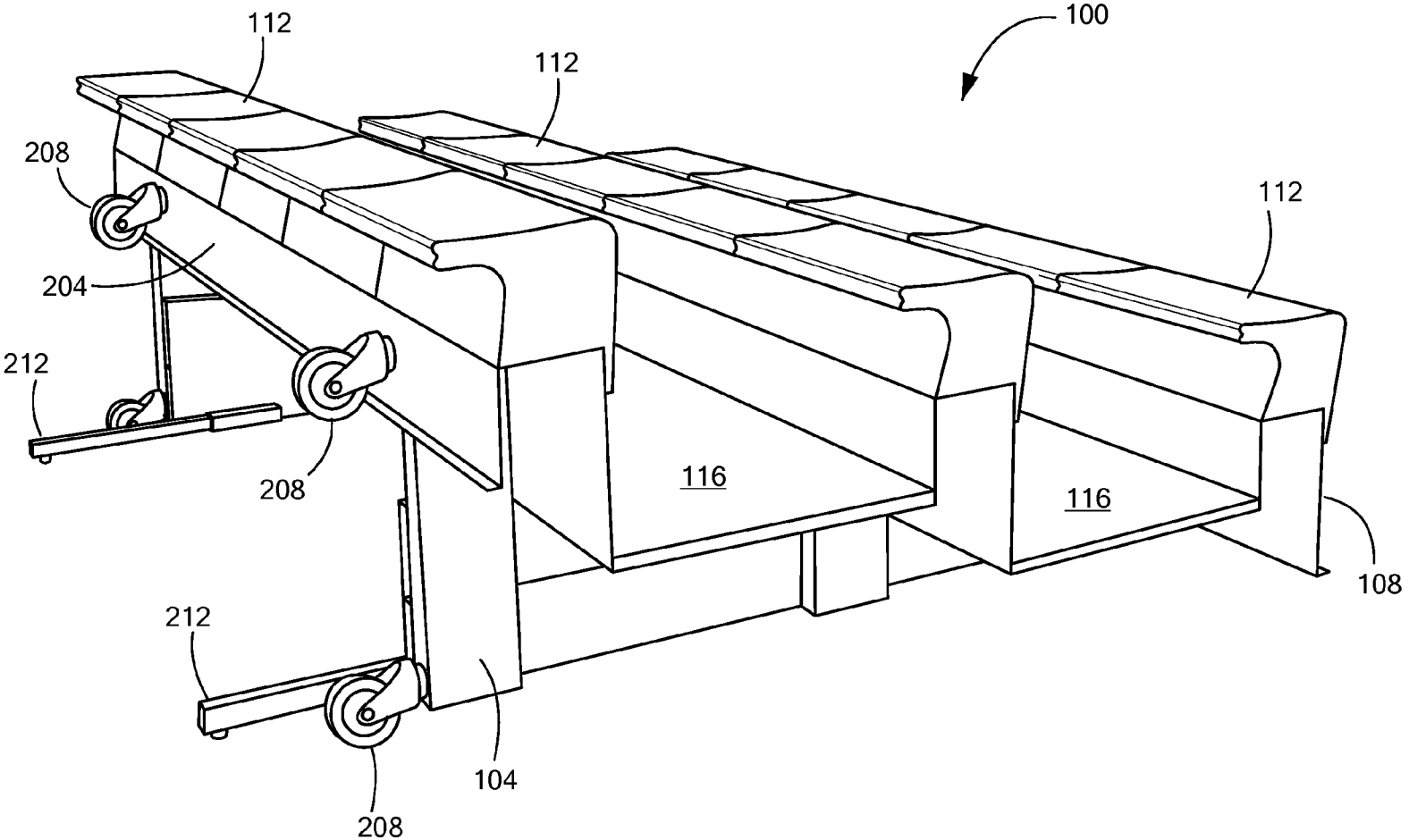
FIG. 2 is a back and side perspective view of the portable bleacher of FIG. 1.

A back section 204 of the portable bleacher 100, as shown in FIG. 2, includes a plurality of transport wheels 208 and a plurality of stabilizer bars 212. One of ordinary skill in the art will understand that the stabilizer bars 212 are used to maintain the portable bleacher 100 in the position as shown in order for a user to sit upon it, as will be better understood in the more detailed description below.

Figure 3A:
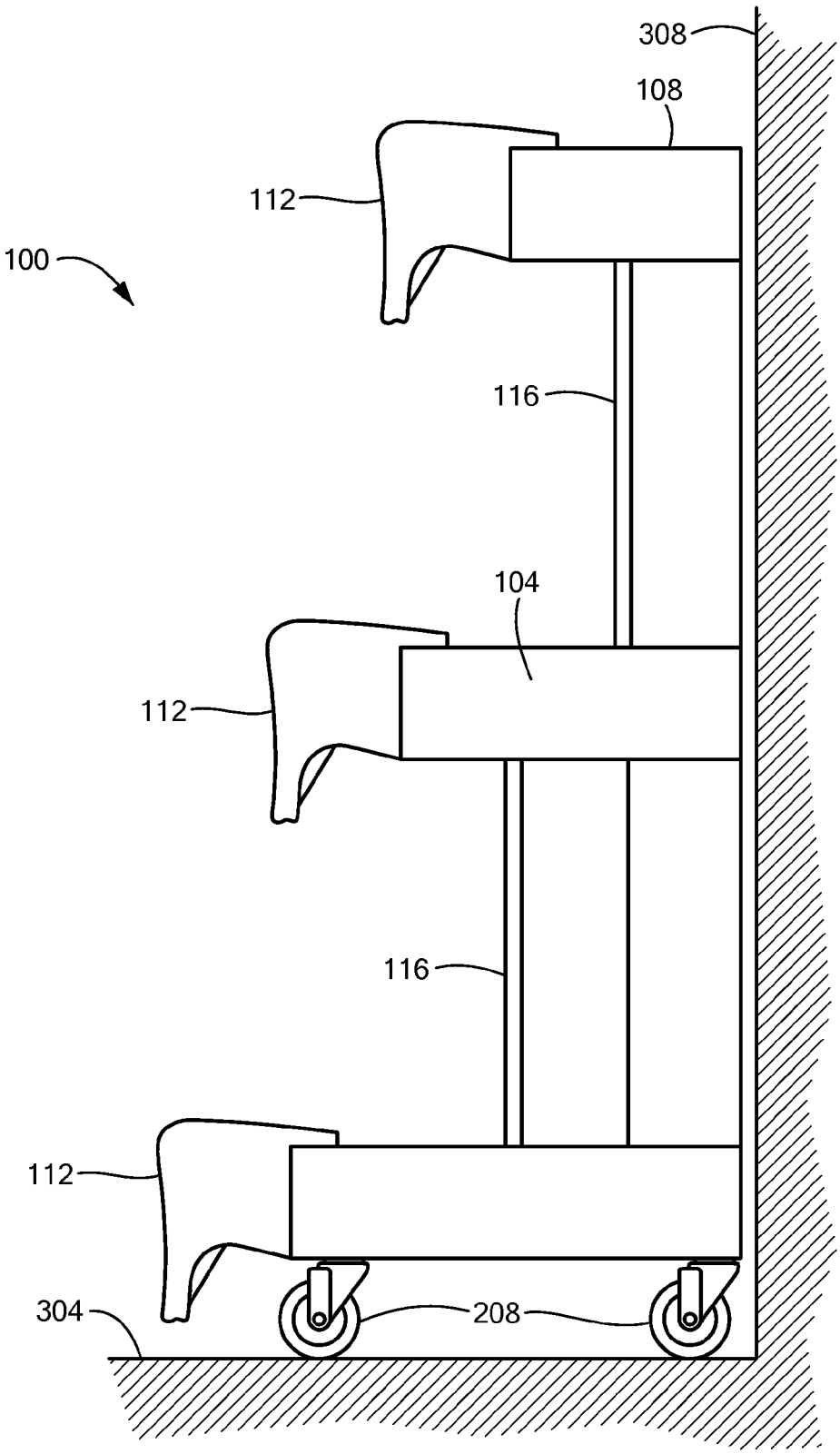
FIGS. 3A and 3B are schematic side views of the portable bleacher of FIG. 1 in a stowed and placed condition, respectively.

Advantageously, the portable bleacher 100 can be oriented onto the transport wheels 208 and moved from one location to another, as needed. When the portable bleacher 100 is not being used, it can be moved along the floor 304 and stored against a vertical wall 308, generally, out of the way as shown in FIG. 3A.

Figure 3B:
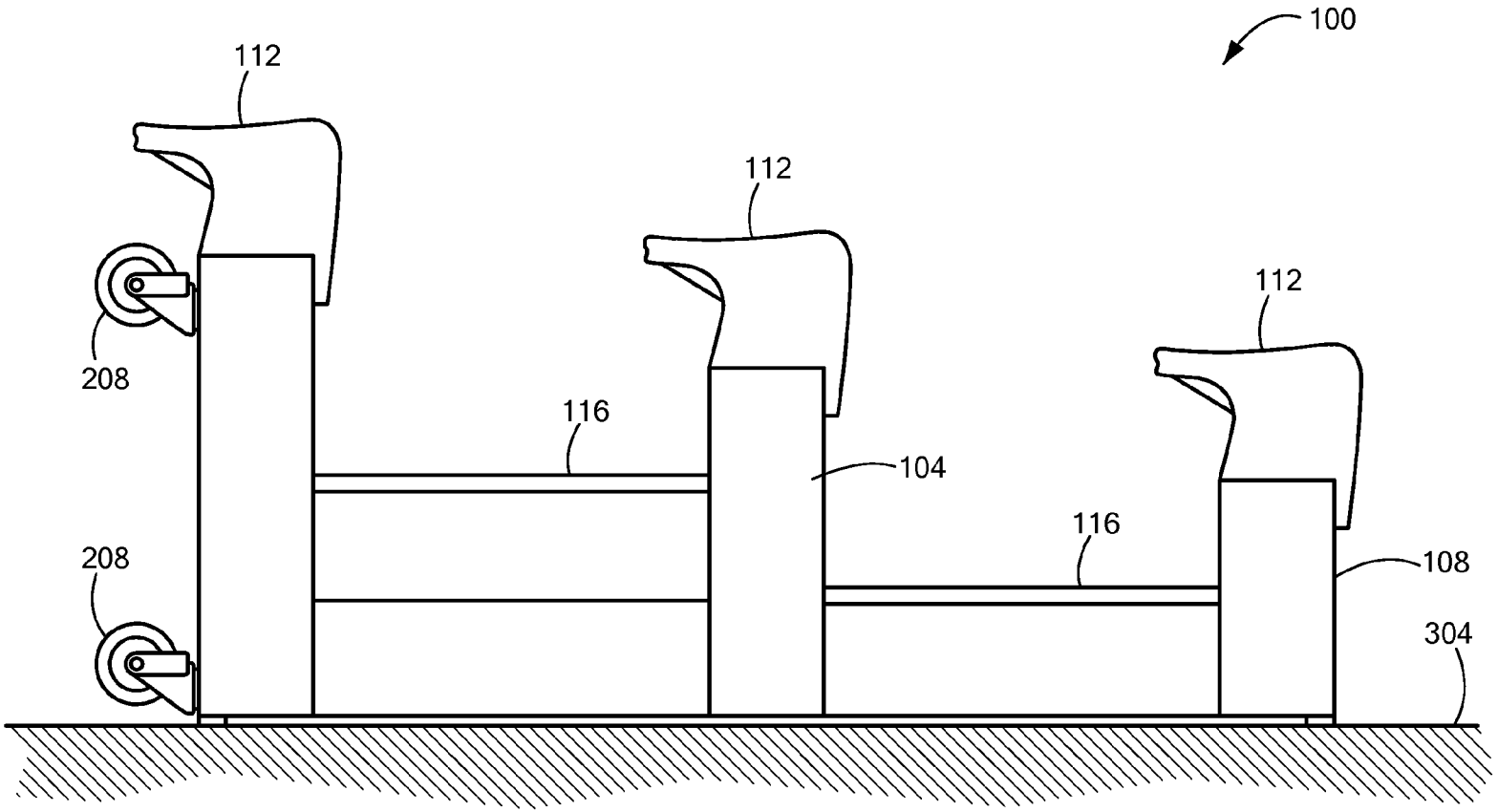

Subsequently, as shown in FIG. 3B, similar to that which is shown in FIG. 2, the portable bleacher 100 can be rolled into position and then placed on the floor 304.

In order to position the portable bleacher 100 in the desired location, referring now to FIGS. 4A-4D, an operator 400 will maneuver the portable bleacher 100 into the general area at which the bleacher 100 is desired. Subsequently, the operator 400 will initialize two placement assemblies 402 to position two respective arms 404 by moving each arm 404 from an initial position to a starting position as indicated by the arrow I.

Figure 4A:
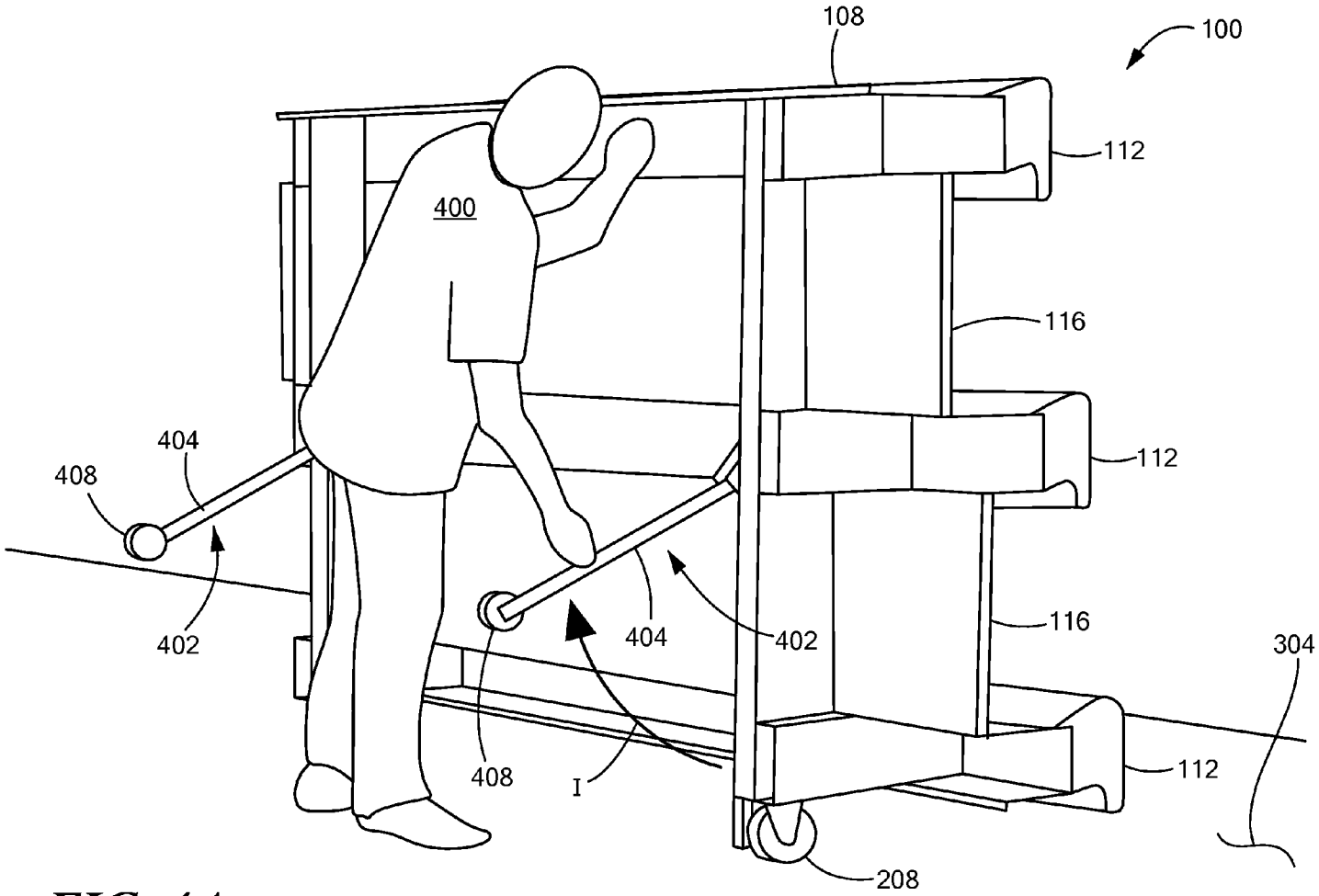
FIGS. 4A-4D depict the placement of the portable bleacher of FIG. 1 in accordance with an embodiment of the present invention.
Figure 4B:
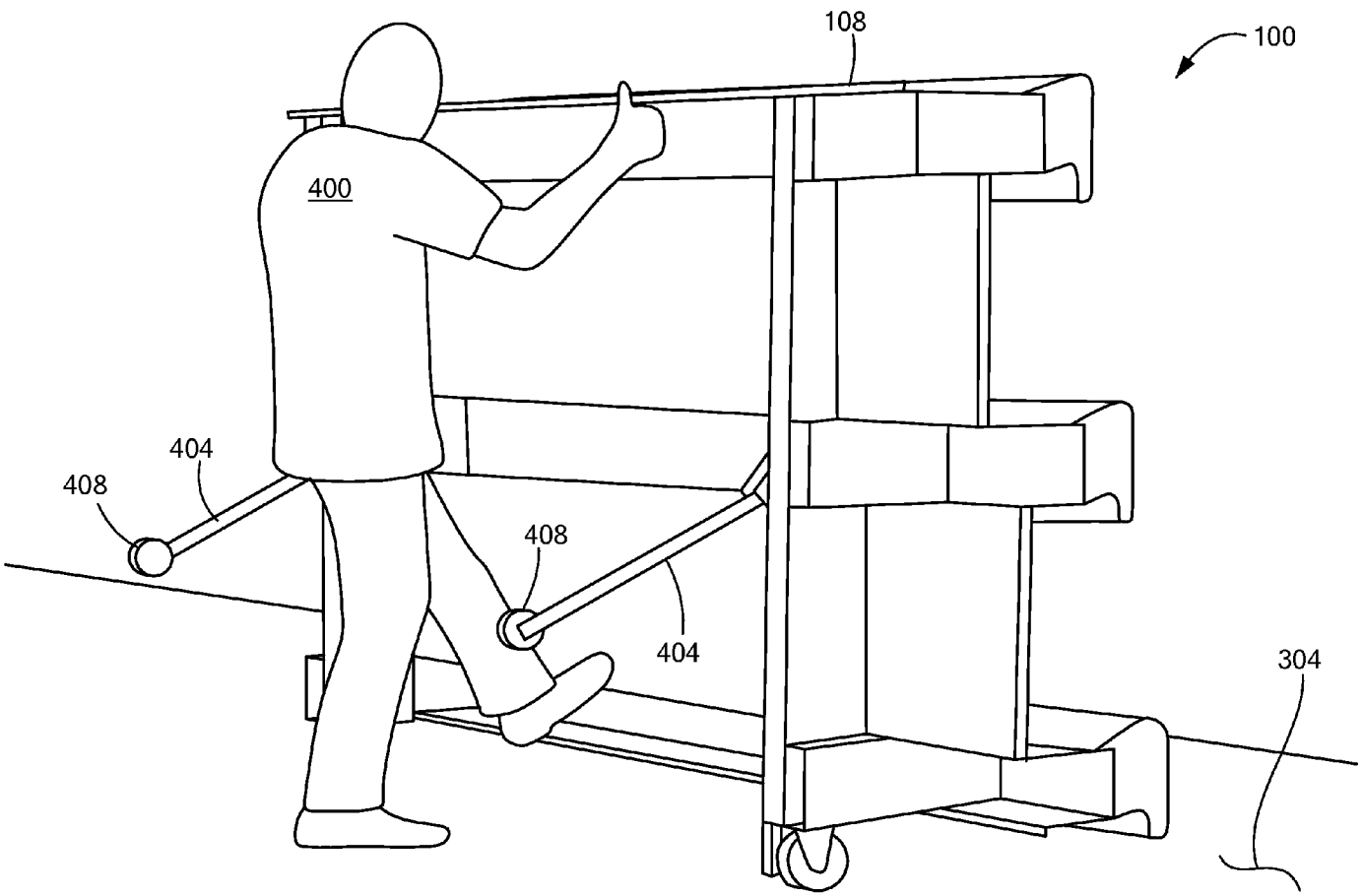
Figure 4C:
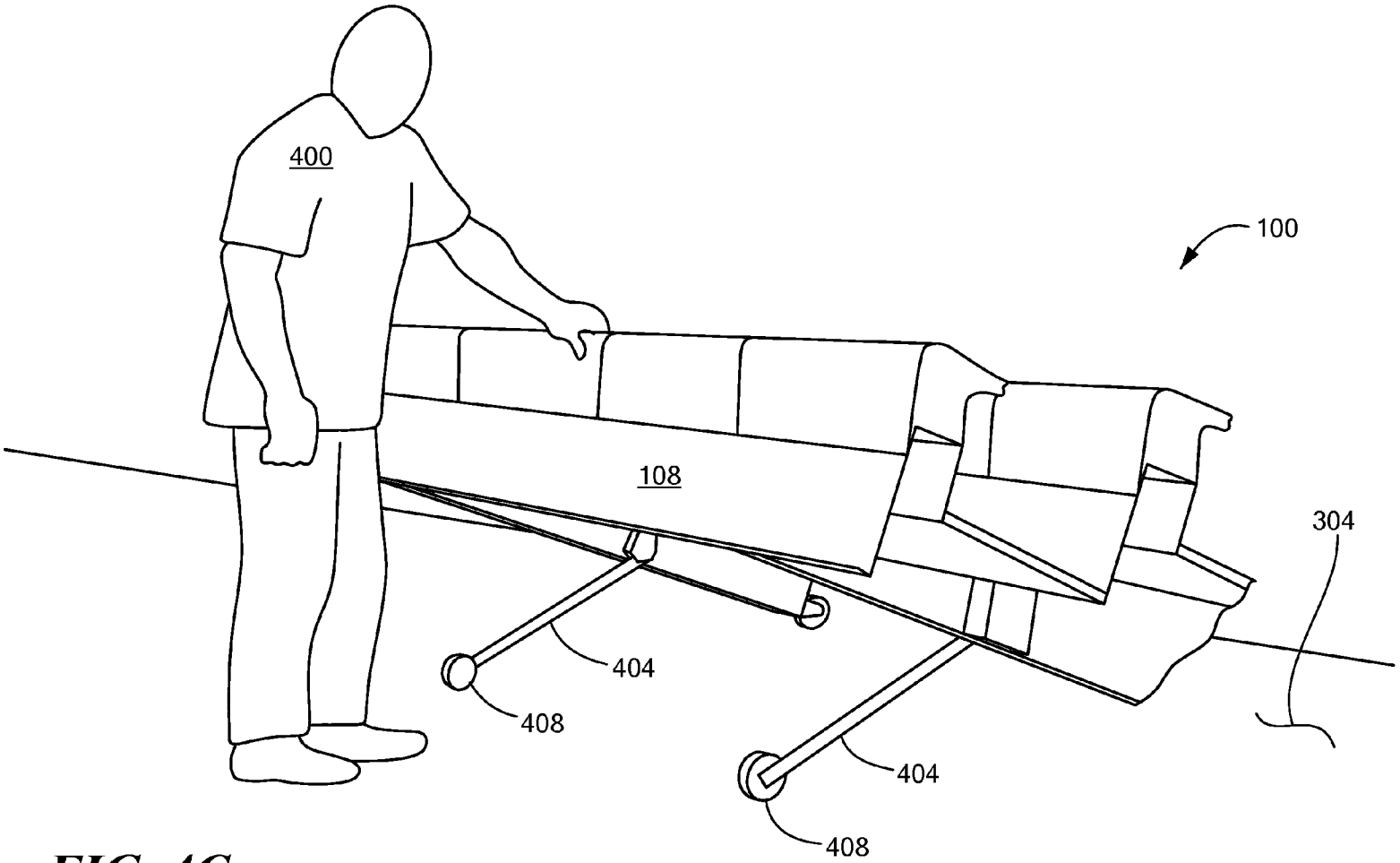
Figure 4D:
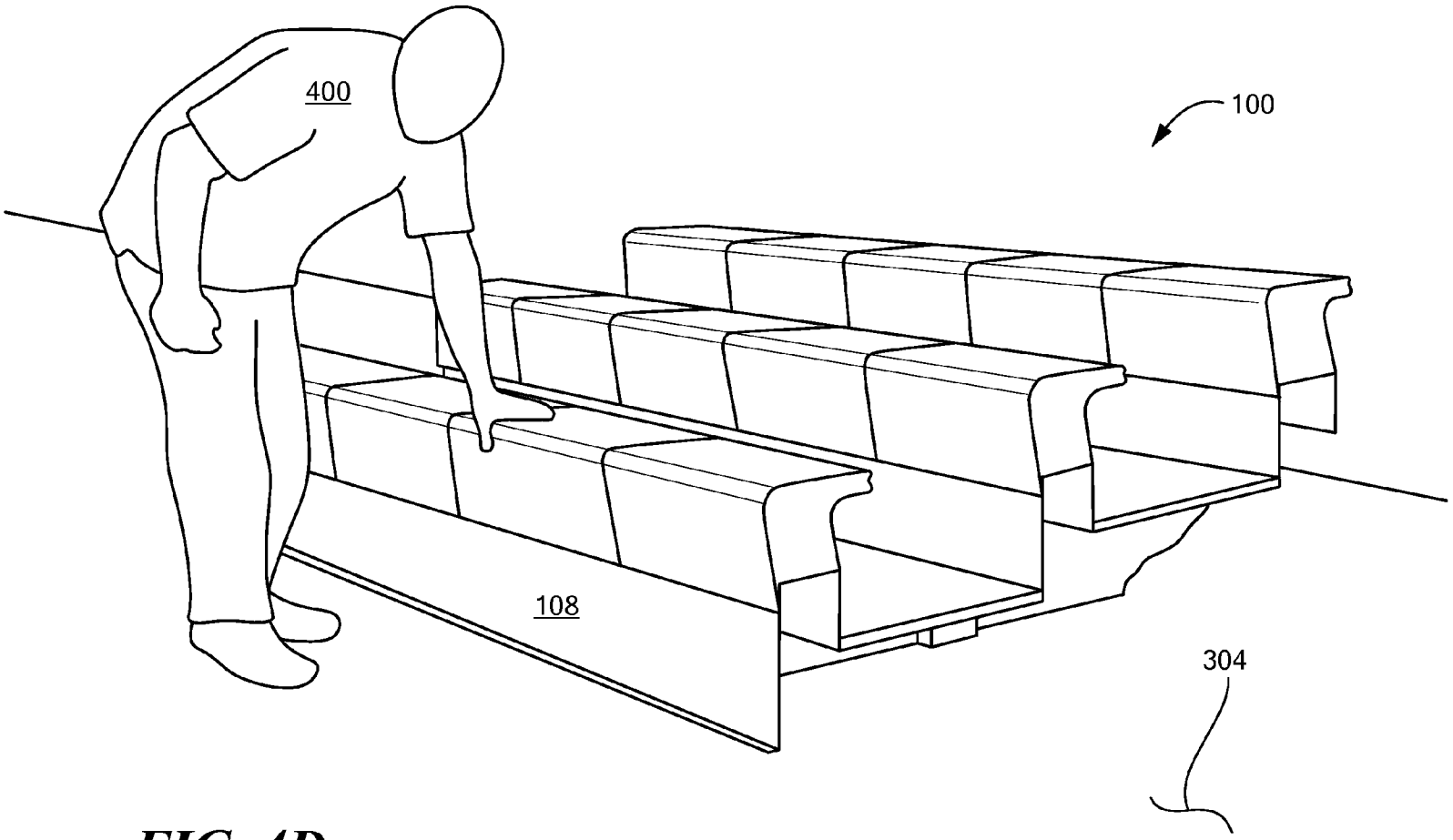

Subsequently, as shown in FIG. 4B, the operator 400 will pivot the portable bleacher 100 forward by pivoting the front portion 108 toward himself. As shown in FIG. 4B, this pivoting motion can be performed by placing a foot on the portable bleacher 100 and pivoting toward the operator 400 on the transport wheels 208. As the portable bleacher 100 is rotating forward, an arm wheel 408 on the arm 404 makes contact with the floor 304 and, by operation of a gas spring, not shown in this figure, the portable bleacher 100 is gradually lowered to the floor 304 and set in place as shown in FIG. 4D. The stabilizer bars 212 would then be extended from the back of the bleacher 100.

Figure 5A:
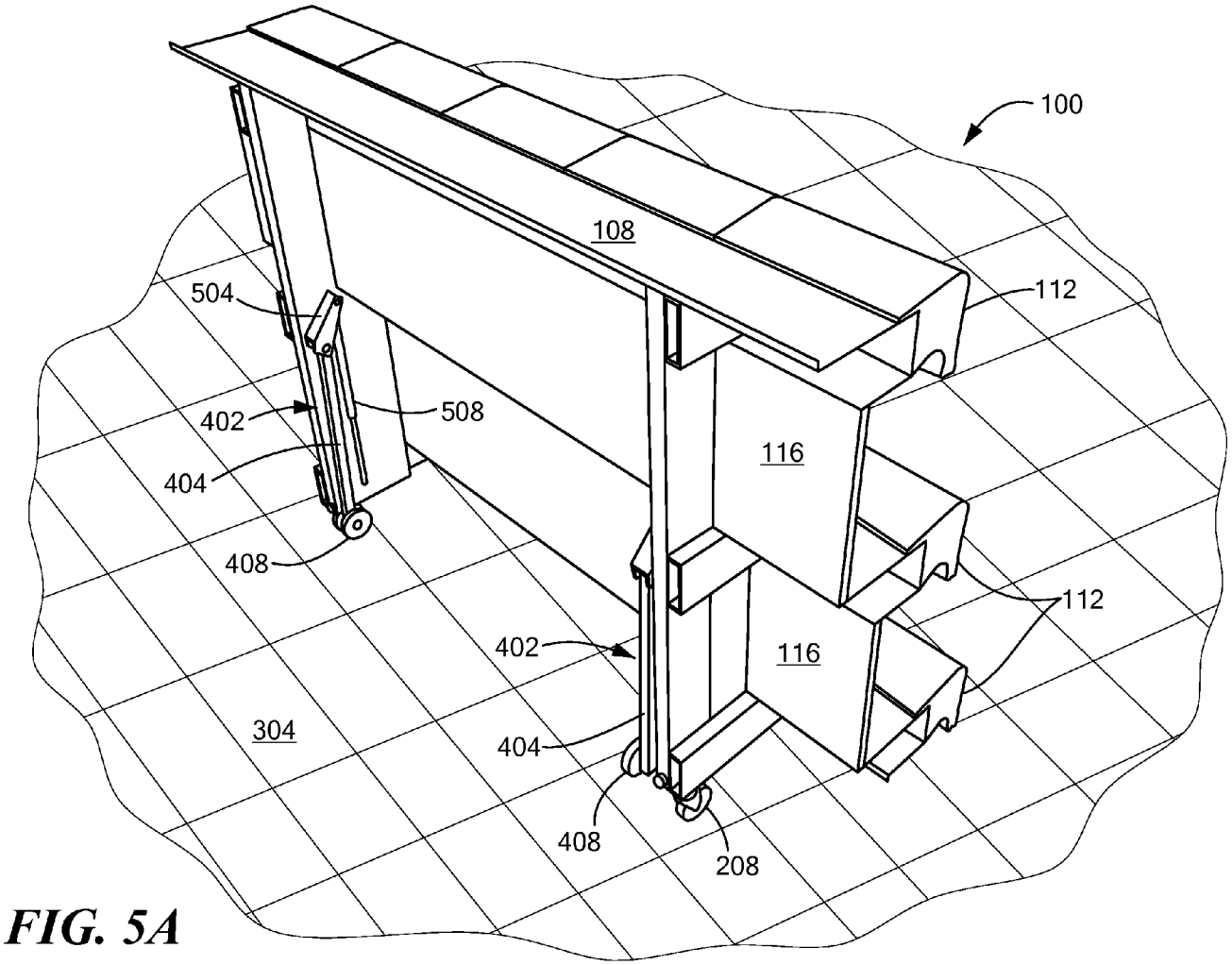
FIGS. 5A-5D are underside views of the portable bleacher of FIG. 1.

Referring now to FIG. 5A, a view from underneath the portable bleacher 100, each placement assembly 402 includes a bracket 504 and a gas spring 508 coupled to the arm 404. As shown in FIG. 5A, the arm 404 is in an initial position while the portable bleacher 100 is shown standing in its stored position on the floor 304.

Figure 5B:
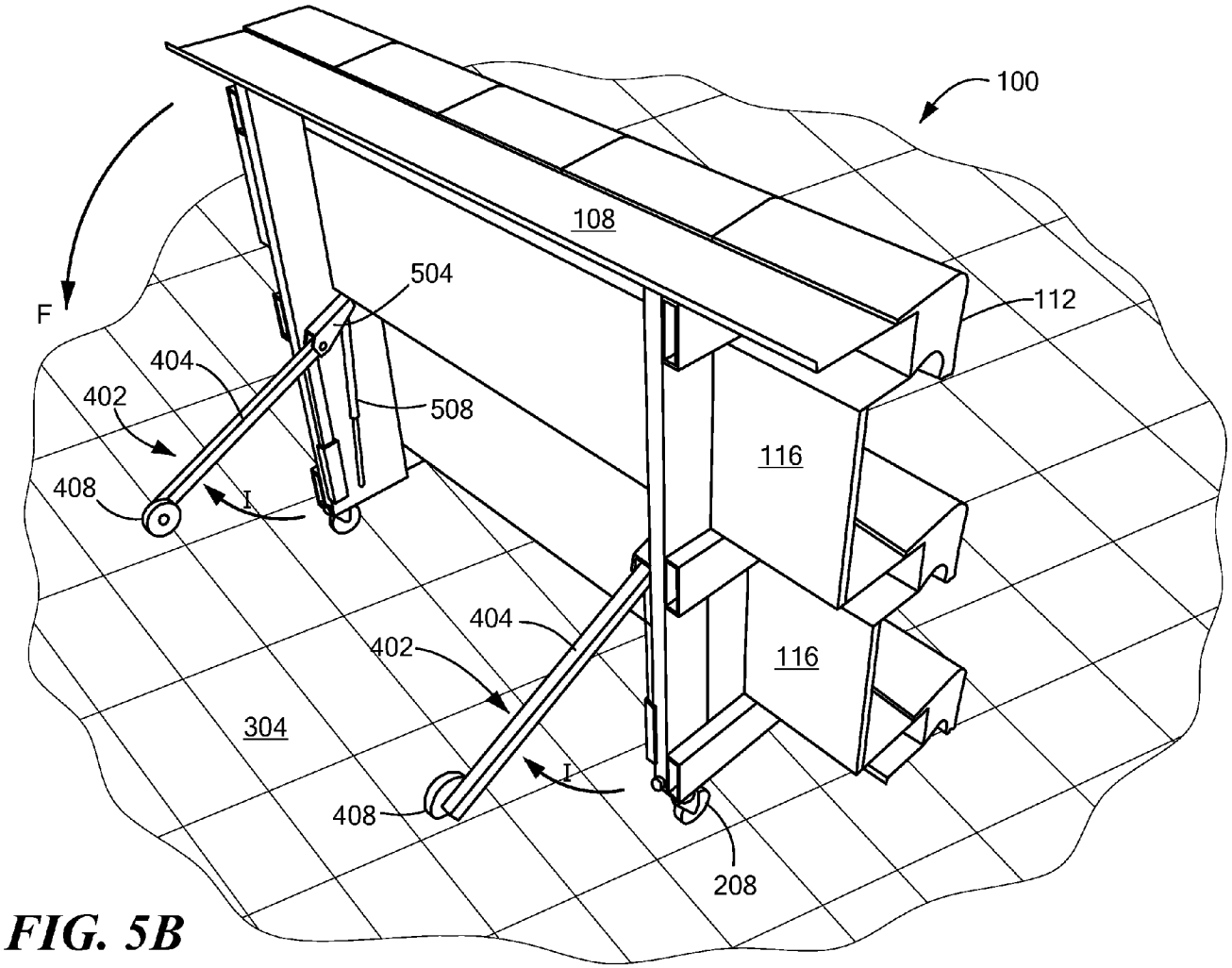
Figure 5C:
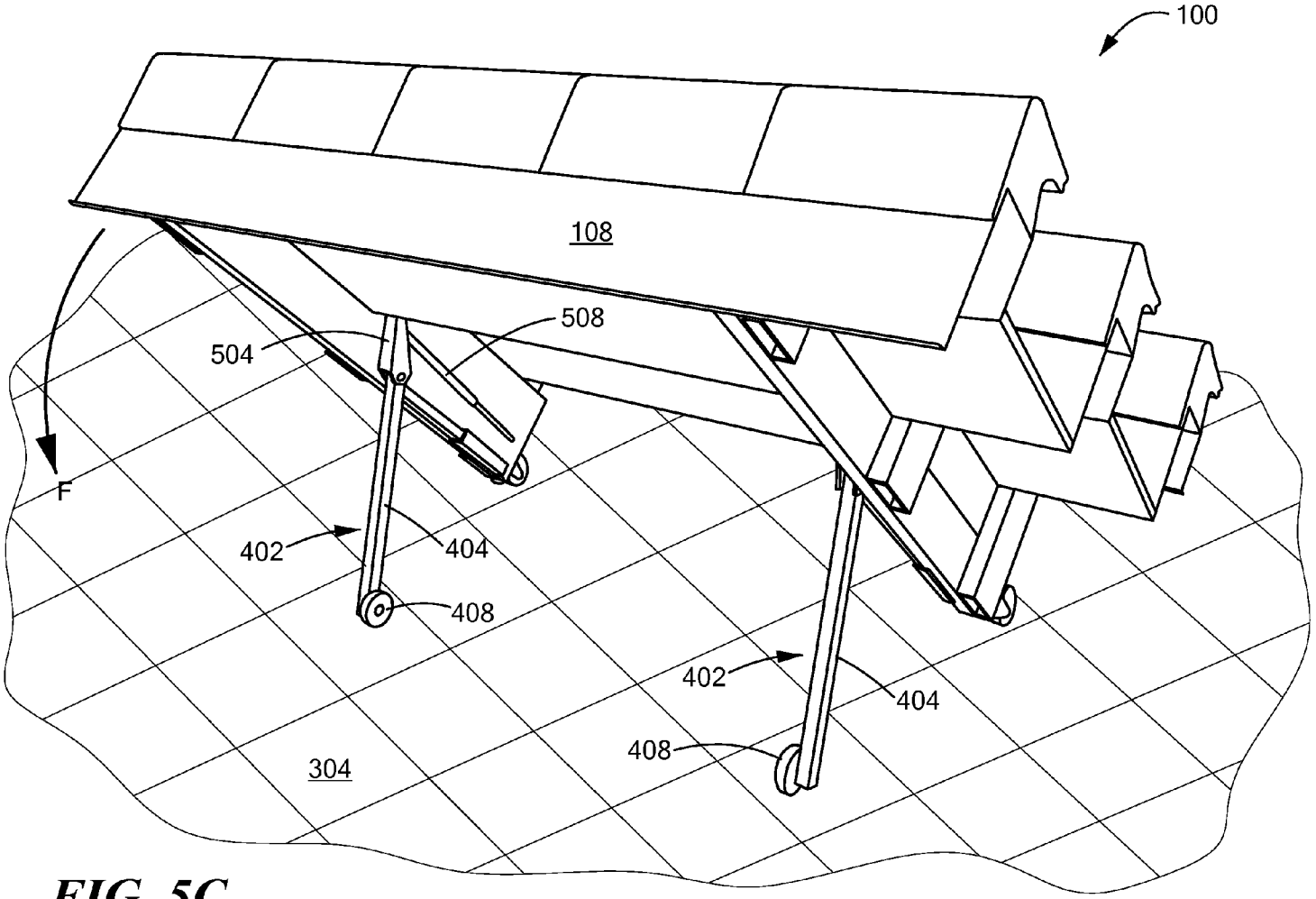

Referring now to FIG. 5B, the arm 404 is moved to an initial position along the arc indicated by the arrow I, similar to that shown in FIG. 4A. Subsequently, as the front portion 108 of the portable bleacher 100 is tipped in the direction indicated by the arrow F, the arm wheel 408 makes contact with the floor 304 and, because the arm 404 is pivotable, as will be described in more detail below, the arm 404 bears the weight of the portable bleacher 100 and brings the portable bleacher 100 into a set position gradually, and under control, as shown in FIG. 4D.

Figure 5D:
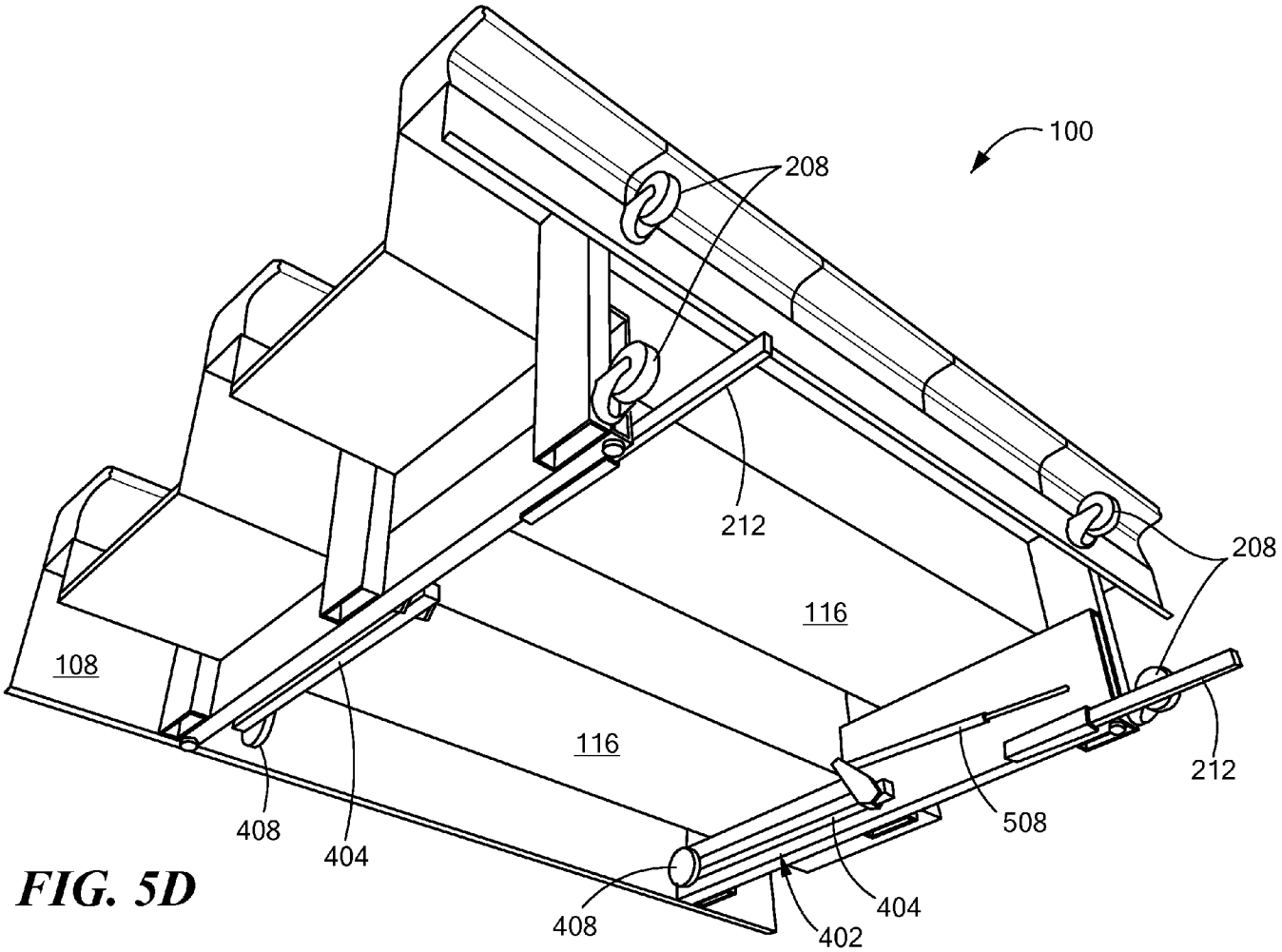

Once the portable bleacher 100 is set into place, the stabilizer bars 212 are extended to prevent the bleacher 100 from tipping up, as shown in FIG. 5D. In addition, as seen in FIG. 5D, the arrangement of the components of the placement assembly 402, the bracket 504, the gas spring 508 and the arm 404, when the bleacher 100 is placed, can be seen.

To remove the bleacher 100 for storage, the foregoing steps are reversed. The stabilizer bars 212 are pushed back in and the front portion 108 is lifted up. The pressure in the gas spring 508 provides a small amount of lift to aid the operator 400 in bringing up the front of the bleacher 100. Once vertical, the arm 404 is placed back in the initial position and the bleacher 100 is stored away or moved to the next location at which it is needed.

Figure 6A:
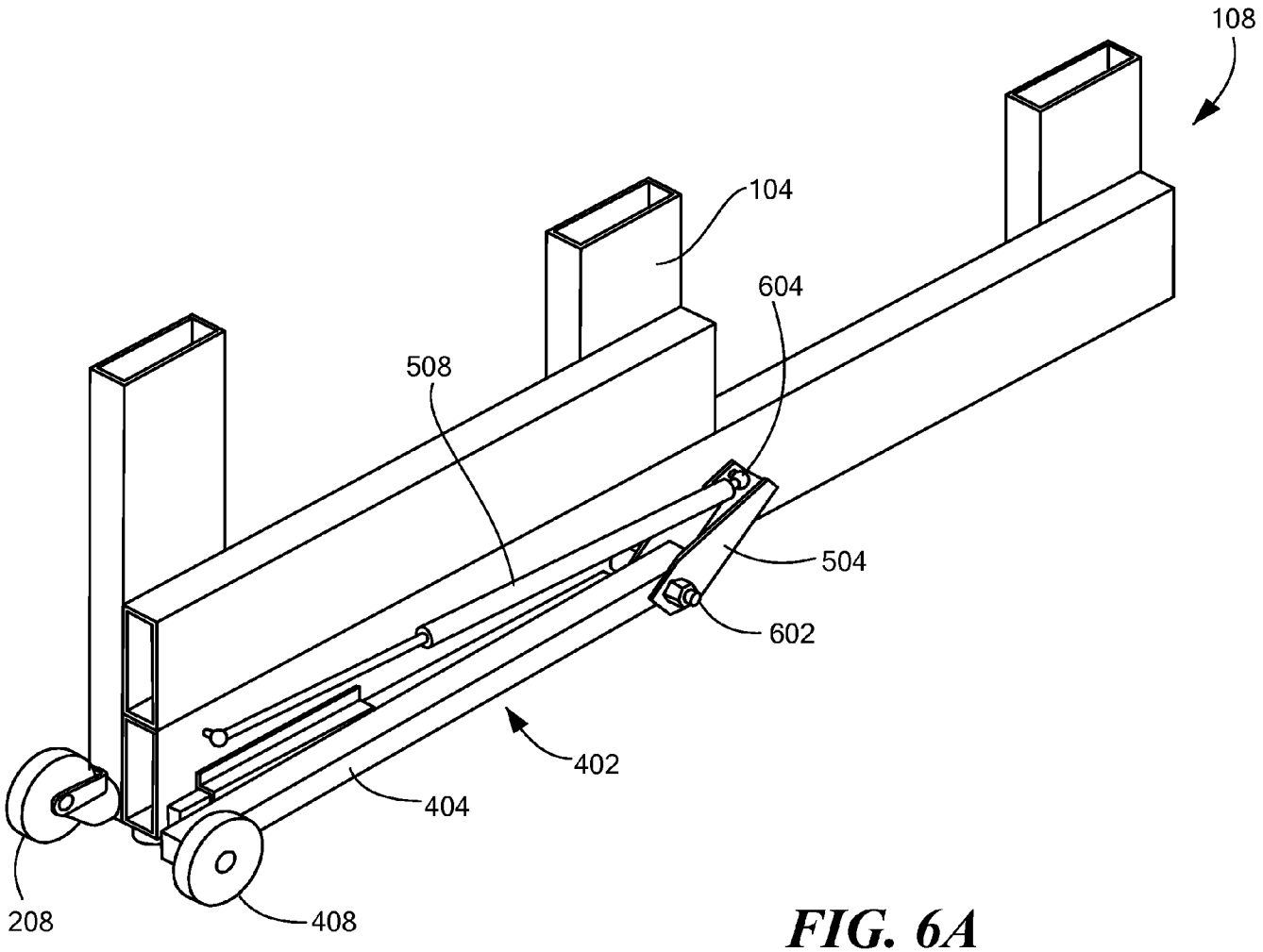
FIGS. 6A and 6B are schematic views of an active descent and lift mechanism in accordance is with an embodiment of the present invention.
Figure 6B:
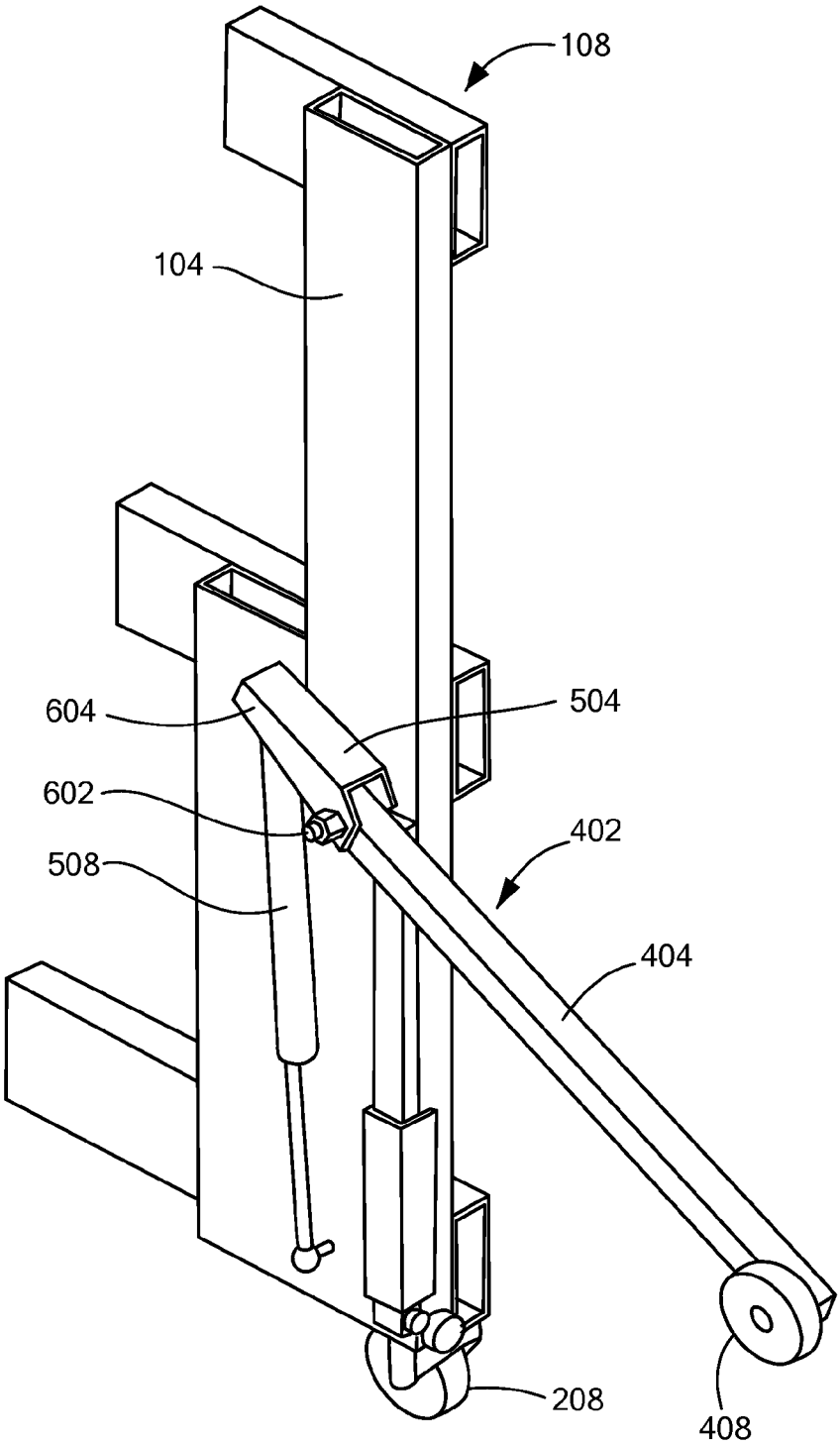

The placement assembly 402, shown in more detail in FIGS. 6A and 6B, includes the arm 404 and the arm wheel 408 along with the bracket 504 connected to the gas spring 508. The arm 404 and the bracket 504 are coupled at an arm pivot point 602 while the bracket 504 couples to the gas spring 508 at a spring pivot point 604, as shown. Similar to that which is shown in FIG. 5A, the placement assembly 402 is shown in the non-deployed state in FIG. 6A and in the initial state in FIG. 6B.

The arm wheel 408 could be made of any material that provides for a relatively low friction movement across the floor 304, such as, a plastic. The arm 404 may be made from aluminum or any other lightweight but strong enough material. In the embodiment shown, the arm wheel 408 is mounted on a fixed axis. In an alternate embodiment, the arm wheel 408 may be mounted on a rotating structure in order to allow for the arm wheel to spin in different planes.

The pressure within the gas spring 508 is chosen to compensate for the weight of the portable bleacher 100 so that the weight of the bleacher 100 overcomes the force of the gas spring 508 gradually and under control. Of course, the pressure within the gas spring 508 is chosen such that it will not cause the bleacher 100 to rise when it is unintended, while still allowing for easy lifting of the bleacher 100 when the bleacher 100 needs to be stowed away. The stabilizer bars 212 are provided to prevent such an occurrence and provide an additional level of safety and stability to the bleacher 100.

While the placement assembly 402 is shown, in one embodiment, as using the gas spring 508 having a charged fluid or gas within, it is expected that any one of a number of equivalent structures could be used. These might include, for example, but not limited to, a mechanical spring, a shock absorber, a system of belts and pulleys, a combination of gears and springs with preset resistances and any combination or sub-combination of the foregoing, as well as other mechanisms understood by those of ordinary skill in the art.

Further, a motor could be used in place of the resistance of the gas spring 508, or equivalent, where the tension, i.e., the opposition to the movement of the arm 404 as the bleacher 100 is positioned, would be implemented by the motor, for example, a stepper motor that incrementally moves the bleacher 100 into position, either automatically or manually under control of an operator.

In addition, while the wheel 408 is shown as being provided at the distal end of the arm 404, depending on the material of the floor 304, any one of a number of other devices could be chosen. These might include, for example, a slider or skid made of a plastic such as Delrin® acetal homopolymer available from E. I. du Pont de Nemours and Company.

Having thus described several features of at least one embodiment of the present invention, it is to be appreciated that various alterations, modifications and improvements will readily occur to is those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A bleacher seating structure, comprising:

a tiered seating assembly comprising a seating portion; and an active placement mechanism mounted on the seating assembly, wherein the active placement mechanism comprises:

a bracket having a first bracket pivot point, the bracket pivotably mounted on the seating assembly at the first bracket pivot point;

a support arm having a first end pivotably connected at the first bracket pivot point of the bracket; and a biasing structure connected to the bracket and to the seating assembly.

2. The bleacher seating structure of claim 1, wherein a biasing force of the biasing structure is set as a function of a weight of the seating assembly.

3. The bleacher seating structure of claim 1, wherein the biasing structure has a first end and the first end of the biasing structure is pivotably connected to the seating assembly.

4. The bleacher structure of claim 1, wherein the biasing structure comprises at least one of:

a gas-charged spring;

a mechanical spring;

a shock absorber;

a mechanism comprising at least one belt and at least one pulley;

a mechanism comprising at least one gear and at least one spring; and a motor.

5. A bleacher seating structure, comprising:

a tiered frame assembly comprising a seating portion; and an active placement mechanism mounted on the frame assembly, wherein the active placement mechanism comprises:

a bracket pivotably mounted on the tiered frame assembly at a first bracket pivot point;

an arm having first and second ends, the first end pivotably connected to the first bracket pivot point; and a biasing spring having a first end pivotably connected to a first end of the bracket and a second end of the biasing spring pivotably connected to the frame assembly.

6. The bleacher seating structure of claim 5, further comprising:

a wheel attached to a second end of the arm.

7. The bleacher seating structure of claim 5, wherein a biasing force of the biasing spring is set as a function of a weight of the frame assembly.

8. The bleacher seating structure of claim 5, wherein the biasing spring is a gas-charged spring having an internal pressure set as a function of a weight of the frame assembly.

9. The bleacher structure of claim 5, wherein the biasing spring comprises at least one of:

a gas-charged spring;

a mechanical spring; and a shock absorber.

10. A bleacher structure for use on a floor, the bleacher structure having a weight and a forward end, the bleacher structure comprising:

a plurality of tiered seating portions each having a seating surface wherein a highest seating portion includes a rear portion and the plurality of seating portions have opposing ends;

deck portions disposed between adjacent pairs of the plurality of seating portions;

a frame assembly having a rear lower portion with first and second ends, the frame assembly being mounted to and supporting the plurality of seating portions and deck portions, wherein the bleacher structure is rotatable around a pivot axis adjacent to and extending between the first and second ends of the rear lower portion of the frame assembly between a first orientation in which the seating surfaces are generally perpendicular to the floor for transport of the bleacher structure and a second orientation in which the seating surfaces are generally parallel to the floor to provide seating;

at least one arm having a length and first and second ends, wherein the first end of the at least one arm is pivotably mounted to the frame and the length is selected such that the second end of the at least one arm comes in contact with the floor upon rotation of the bleacher structure from the first orientation to the second orientation, the at least one arm including a counterbalance assembly and being pivotable with respect to the frame assembly during rotation of the bleacher structure between the first and second orientations, the at least one arm and included counterbalance assembly configured to at least partially support the weight of the bleacher structure at the forward end as the bleacher structure is being rotated from the first orientation to the second orientation.

11. The bleacher structure of claim 10 wherein the counterbalance assembly is configured to at least partially support the weight of the bleacher structure as the bleacher structure is being rotated from the second orientation to the first orientation.

12. The bleacher structure of claim 10 further including first and second pairs of wheels mounted to and supporting the bleacher structure to permit rolling movement of the bleacher structure when disposed in the first orientation.

13. The bleacher structure of claim 12 wherein the first pair of wheels are mounted to the rear lower portion of the frame and the bleacher structure is rotatable between the first and second orientations on the first pair of wheels.

14. The bleacher structure of claim 10 wherein the second end of the at least one arm includes a wheel that abuts the floor as the bleacher structure is rotated from the first orientation to the second orientation.

15. The bleacher structure of claim 10 wherein the counterbalance assembly includes a mechanical spring.

16. The bleacher structure of claim 10 wherein the counterbalance assembly includes a gas spring.

17. The bleacher structure of claim 10 wherein the counterbalance assembly includes a shock absorber.

18. The bleacher structure of claim 10 wherein the counterbalance assembly includes a motor.

19. The bleacher structure of claim 10 further including a skid mounted to the second end of the arm.

* * * * *